US010405399B1

(12) United States Patent
Fan

(10) Patent No.: US 10,405,399 B1
(45) Date of Patent: Sep. 3, 2019

(54) STREET LIGHT DEVICE AND OPERATION METHOD THEREOF

(71) Applicants: LITE-ON ELECTRONICS (GUANGZHOU) LIMITED, Guangzhou (CN); Lite-On Technology Corporation, Taipei (TW)

(72) Inventor: Li-Ta Fan, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 16/186,591

(22) Filed: Nov. 12, 2018

(30) Foreign Application Priority Data

Sep. 28, 2018 (CN) ..... 2018 1 1138205

(51) Int. Cl.
*H05B 33/08* (2006.01)

(52) U.S. Cl.
CPC ..... *H05B 33/0872* (2013.01)

(58) Field of Classification Search
CPC ..... H05B 33/0872; H05B 33/0869; H05B 33/086; H05B 33/0857; H05B 37/02; H05B 37/029; H05B 37/0209; G08G 1/095; G08G 1/166; F21S 2/00; F21S 8/086; Y02B 20/72
See application file for complete search history.

(56) References Cited

U.S. PATENT DOCUMENTS

| | | | | |
|---|---|---|---|---|
| 6,676,279 | B1 * | 1/2004 | Hubbell | F21S 8/088 362/293 |
| 9,900,960 | B1 * | 2/2018 | Lin | H05B 33/0857 |
| 9,955,551 | B2 * | 4/2018 | Spero | B60Q 1/04 |
| 10,234,129 | B2 * | 3/2019 | Oostdyk | F21V 29/83 |
| 2015/0346320 | A1 * | 12/2015 | Hartman | H05B 37/0227 315/312 |
| 2016/0131327 | A1 * | 5/2016 | Moon | H01L 33/58 362/235 |

* cited by examiner

*Primary Examiner* — Haissa Philogene
(74) *Attorney, Agent, or Firm* — JCIPRNET

(57) ABSTRACT

A street light device includes a light emitting module, a driving circuit, a sensing module, and a microcontroller. The light emitting module includes a first light emitting unit and a second light emitting unit. The sensing module obtains a temperature, a relative humidity, and a dust concentration. The microcontroller calculates a light attenuation rate according to the temperature, the relative humidity, and the dust concentration. The microcontroller controls the driving circuit according to the light attenuation rate to drive the first light emitting unit and the second light emitting unit, so that a color temperature ratio between the first light emitting unit and the second light emitting unit is determined according to the light attenuation rate.

10 Claims, 4 Drawing Sheets

STREET LIGHT DEVICE AND OPERATION METHOD THEREOF

CROSS REFERENCE TO RELATED APPLICATION

This application claims the priority benefit of China application serial no. 201811138205.0, filed on Sep. 28, 2018. The entirety of the above-mentioned patent application is hereby incorporated by reference herein and made a part of specification.

BACKGROUND OF THE INVENTION

Field of the Invention

The disclosure relates to an illumination apparatus and, more particularly, to a street light device and an operation method thereof.

Description of Related Art

In general, street light devices beside the road are used at night or when there is poor lighting, so the illumination effect of the street light devices is an important factor affecting the users' safety when driving in the dark environment. However, for most traditional street light devices, either one fixed color temperature is adopted, or a nephelometer performs a wide-range measurement and then the color temperature of multiple street light devices may be adjusted wirelessly at the same time. Accordingly, general nephelometers require high installation cost, have limited measurement accuracy, and may have the problem of unstable connection since the nephelometers are controlled wirelessly. In view of the above, several embodiments will be presented below, illustrating how to achieve a street light device that effectively and automatically adjusts the color temperature of the illumination light to provide a good illumination effect.

SUMMARY OF THE INVENTION

A street light device and an operation method thereof that effectively provide a corresponding illumination effect according to the surrounding environment of the street light device are provided.

A street light device of the disclosure includes a light emitting module, a driving circuit, a sensing module, and a microcontroller. The light emitting module includes a first light emitting unit and a second light emitting unit. The driving circuit is coupled to the light emitting module. The driving circuit is configured to drive the first light emitting unit and the second light emitting unit. The sensing module is configured to obtain a temperature, a relative humidity, and a dust concentration. The microcontroller is coupled to the sensing module and the driving circuit. The microcontroller is configured to calculate a light attenuation rate according to the temperature, the relative humidity, and the dust concentration. The microcontroller controls the driving circuit according to the light attenuation rate to drive the first light emitting unit and the second light emitting unit, so that a color temperature ratio between the first light emitting unit and the second light emitting unit is determined according to the light attenuation rate.

An operation method of the disclosure is adapted for the street light device. The operation method includes the following. A temperature, a relative humidity, and a dust concentration are obtained by a sensing module. A light attenuation rate is calculated according to the temperature, the relative humidity, and the dust concentration by a microcontroller. A first light emitting unit and a second light emitting unit are driven according to the light attenuation rate by a driving circuit, so that a color temperature ratio between the first light emitting unit and the second light emitting unit is determined according to the light attenuation rate.

Based on the above, the street light device and the operation method thereof of this disclosure calculate a light attenuation rate by instantly sensing the environmental parameters of the surrounding environment of the street light device. Next, the street light device and the operation method thereof of this disclosure automatically adjust the brightness of the first light emitting unit and the second light emitting unit having different color temperatures according to the light attenuation rate, so that the color temperature of the illumination light provided by the street light device may be adjusted correspondingly.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
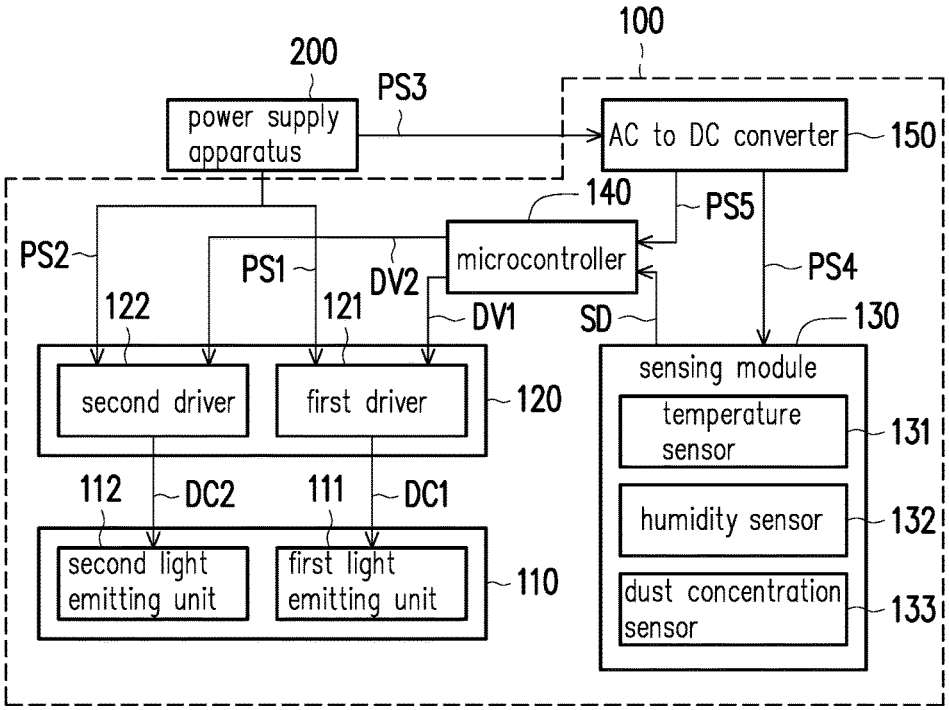
FIG. 1 is a schematic view of a functional circuit diagram of a street light device according to an embodiment of the disclosure.

In order to make the disclosure more comprehensible, several embodiments are described below as examples of implementation of the disclosure. Moreover, elements/components/steps with the same reference numerals are used to represent identical or similar parts in the figures and embodiments where appropriate.

FIG. 1 is a schematic view of a functional circuit diagram of a street light device according to an embodiment of the disclosure. Referring to FIG. 1, a street light device 100 includes a light emitting module 110, a driving circuit 120, a sensing module 130, a microcontroller 140, and an AC to DC converter 150. The street light device 100 may be coupled to an external power supply apparatus 200, and the power supply apparatus 200 may be, for example, the domestic power. The light emitting module 110 includes a first light emitting unit 111 and a second light emitting unit 112. The driving circuit 120 includes a first driver 121 and a second driver 122. The sensing module 130 includes a temperature sensor 131, a humidity sensor 132, and a dust concentration sensor 133. In this embodiment, the power supply apparatus 200 is adapted to respectively provide an AC power signal PS1 and an AC power signal PS2 to the first driver 121 and the second driver 122, and to provide an AC power signal PS3 to the AC to DC converter 150. The AC to DC converter 150 is adapted to convert the AC power signal PS3 into a DC power signal PS4 and a DC power signal PS5, and to respectively provide the DC power signal PS4 and the DC power signal PS5 to the sensing module 130 and the microcontroller 140.

In this embodiment, the temperature sensor 131 of the sensing module 130 is adapted to sense the temperature of the surrounding environment of the street light device 100 to obtain a temperature. The humidity sensor 132 of the sensing module 130 is adapted to sense the relative humidity of the surrounding environment of the street light device 100 to obtain a relative humidity. The dust concentration sensor 133 of the sensing module 130 is adapted to sense the dust concentration of the surrounding environment of the street light device 100 to obtain a dust concentration. In this embodiment, the sensing module 130 provides a sensing data SD including the above parameters to the microcontroller 140, so that the microcontroller 140 performs calculation according to the temperature, the relative humidity, and the dust concentration to obtain a light attenuation rate. Moreover, the microcontroller 140 may respectively output a first adjusting voltage DV1 and a second adjusting voltage DV2 to the first driver 121 and the second driver 122 according to the light attenuation rate, so that the first driver 121 and the second driver 122 correspondingly output a first driving current DC1 and a second driving current DC2 respectively to the first light emitting unit 111 and the second light emitting unit 112. Therefore, a color temperature ratio between the first light emitting unit 111 and the second light emitting unit 112 is determined according to the light attenuation rate calculated above.

In this embodiment, the first light emitting unit 111 and the second light emitting unit 112 may be light emitting diodes (LEDs), but the disclosure is not limited thereto. The first light emitting unit 111 and the second light emitting unit 112 are adapted to provide illumination light of different color temperatures. For example, in an embodiment, a color temperature of the first light emitting unit 111 is, for example, an illumination light of 2700K, and a color temperature of the second light emitting unit 112 is, for example, an illumination light of 5000K. In addition, the microcontroller 140 may include a central processing unit (CPU) with data processing and computing functions, or other programmable microprocessors for general use or special use, a digital signal processor (DSP), a programmable controller, an application specific integrated circuit (ASIC), a programmable logic device (PLD), other similar processing devices, or a combination of the foregoing devices.

Figure 2:
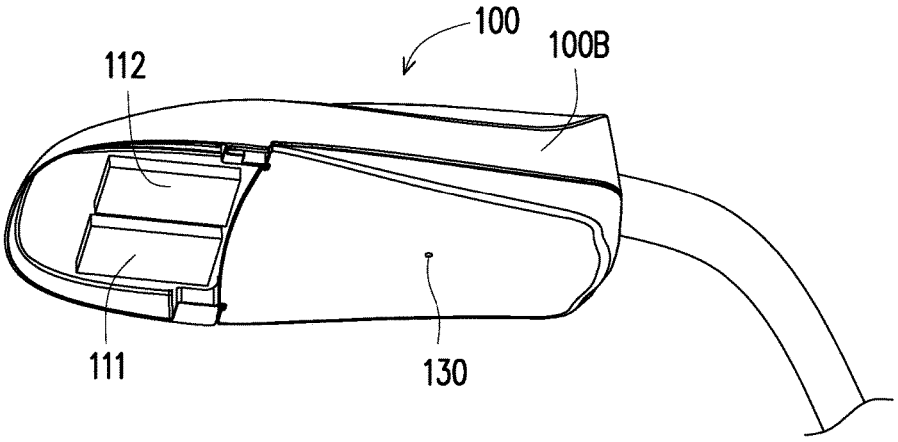
FIG. 2 is a schematic view of a street light device according to an embodiment of the disclosure.

FIG. 2 is a schematic view of a street light device according to an embodiment of the disclosure. Referring to FIG. 1 and FIG. 2, the hardware configuration of the street light device 100 may be as shown in FIG. 2, but the disclosure is not limited thereto. In this embodiment, the street light device 100 includes a device body 100B and is coupled to the external power supply apparatus 200. The device body 100B houses the light emitting module 110, the driving circuit 120, the sensing module 130, the microcontroller 140, and the AC to DC converter 150. In this embodiment, the first light emitting unit 111 and the second light emitting unit 112 may be juxtaposed to respectively emit an illumination light toward an illumination area, and the sensing module 130 senses the illumination area to obtain environmental parameters of the surrounding environment of the illumination area or the street light device 100. The environmental parameters include temperature, relative humidity, and dust concentration.

In this embodiment, the microcontroller 140 of this embodiment calculates the light attenuation rate S (%) according to the following Formula (1).

$$\frac{\alpha\times\left(0.6219\times\frac{P_S\times RH}{P-P_S\times RH}\times\rho_{dry\ air}\right)+\beta\times\frac{PM}{10^9}}{\rho_{dry\ air}}-100\%=S(\%) \qquad \text{Formula (1)}$$

In the above Formula (1), P is the atmospheric pressure (Pa) in a standard state. $P_S$ is the saturated vapor pressure (Pa). RH is the relative humidity (%). $\rho_{dry\ air}$ is the density of dry air (kg/m$^3$). PM is the dust concentration (μg/m$^3$). α and β are operating coefficients.

The processes of the microcontroller 140 obtaining the light attenuation rate S (%) are described in detail as below. First, the microcontroller 140 obtains the temperature, the relative humidity RH, and the dust concentration PM respectively through the temperature sensor 131, the humidity sensor 132, and the dust concentration sensor 133. Then, the microcontroller 140 calculates the saturated vapor pressure $P_S$ according to the temperature, and calculates the density of moist air (kg/m$^3$) according to the relative humidity RH, the saturated vapor pressure $P_S$, and the density of dry air $\rho_{dry\ air}$, such as:

$$\left(0.6219\times\frac{P_S\times RH}{P-P_S\times RH}\times\rho_{dry\ air}\right).$$

Finally, the microcontroller 140 multiplies the density of moist air by the operating coefficient α, adds the result of the dust concentration PM multiplying by the operating coefficient β and multiplying by $1/10^9$, then is divided by the density of dry air $\rho_{dry\ air}$, then minuses 100%, and the light attenuation rate S (%) is thereby obtained.

In other words, the street light device 100 of this embodiment calculates the current difference ratio (i.e., the above-described light attenuation rate S (%)) of the density of mixed air to the density of dry air of the surrounding environment of the street light device 100 by instantaneously and automatically sensing the temperature, the relative humidity, and the dust concentration of the surrounding environment of the street light device 100, and dynamically adjusts the brightness of the first light emitting unit 111 and the second light emitting unit 112 according to the calculation result, so that the color temperature ratio between the first light emitting unit 111 and the second light emitting unit 112 is determined according to the light attenuation rate. Compared with general nephelometers, the temperature sensor 131, the humidity sensor 132, and the dust concentration sensor 133 have the advantages of small size and low cost for installation.

Figure 3:
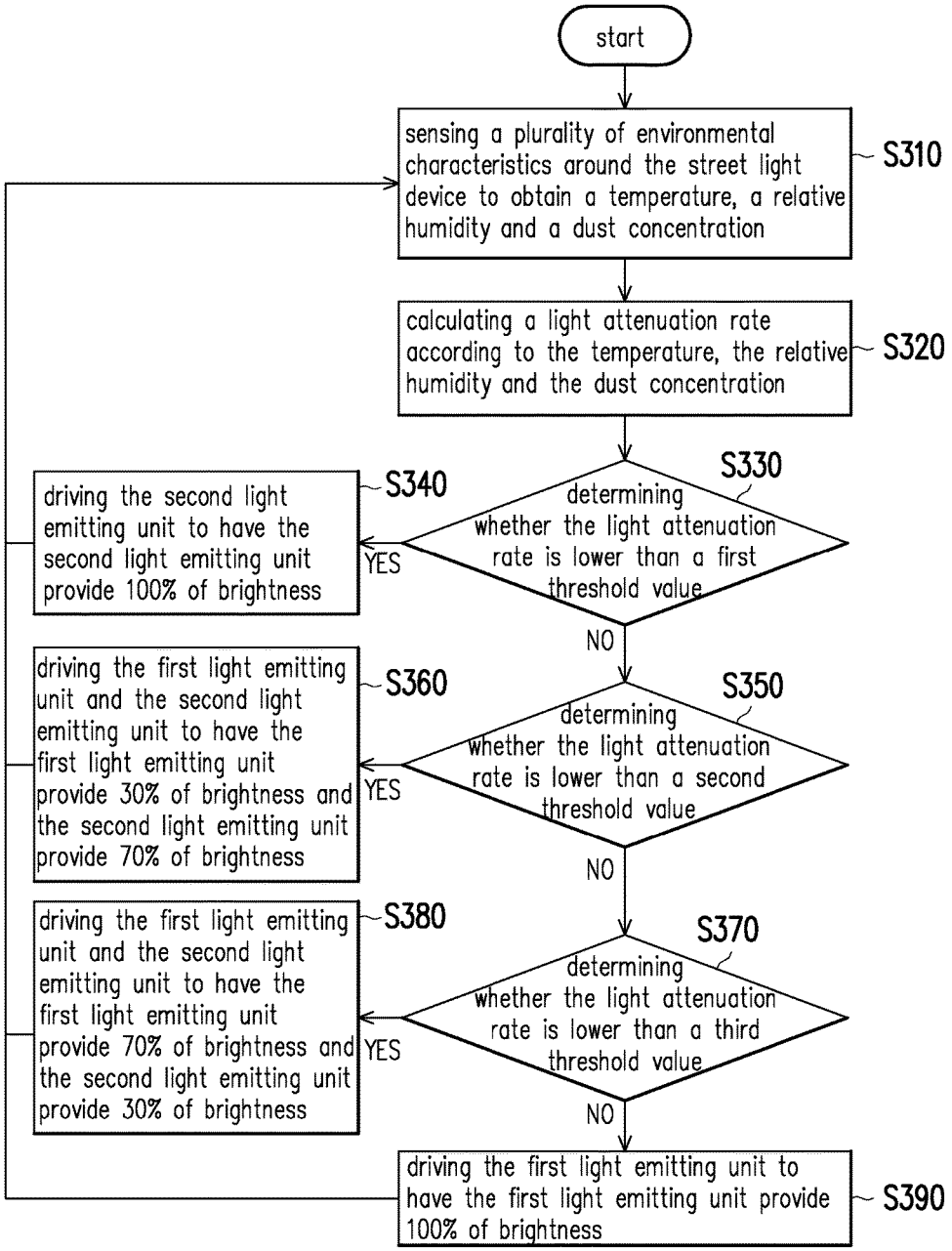
FIG. 3 is a flowchart of an operation method of a street light device according to an embodiment of the disclosure.

FIG. 3 is a flowchart of an operation method of a street light device according to an embodiment of the disclosure. Referring to FIG. 1 and FIG. 3, the method of FIG. 3 is at least applicable to the street light device 100 shown in FIG. 1 and the street light device 100 shown in FIG. 2. In this embodiment, the first light emitting unit 111 may have a fixed first color temperature, and the second light emitting unit 112 may have a fixed second color temperature, wherein the first color temperature is lower than the second color temperature. In this embodiment, the microcontroller 140 may preset one or more than one threshold values to dynamically adjust the first driving current DC1 output to the first light emitting unit 111 via the driving circuit 120 and the second driving current DC2 output to the second light emitting unit 112 via the driving circuit 120 by determining the relationship between the light attenuation rate and the threshold values. In this embodiment, the value of the light attenuation rate is proportional to the current value of the first driving current DC1, and the value of the light attenuation rate is inversely proportional to the current value DC2 of the second driving current. In other words, when the light attenuation rate gets higher, the brightness of the first light emitting unit 111 gets higher as the brightness of the second light emitting unit 112 gets lower. In contrast, when the light attenuation rate gets lower, the brightness of the first light emitting unit 111 gets lower as the brightness of the second light emitting unit 112 gets higher.

For example, the microcontroller 140 may preset three threshold values for the street light device 100 to perform step S310 to step S390. In step S310, the street light device 100 senses a plurality of environmental characteristics around the street light device 100 by the sensing module 130 to obtain a temperature, a relative humidity, and a dust concentration. In step S320, the microcontroller 140 of the street light device 100 calculates a light attenuation rate (i.e., the light attenuation rate S (%) as described in the above embodiment) according to the temperature, the relative humidity, and the dust concentration. In step S330, the microcontroller 140 determines whether the light attenuation rate is lower than a first threshold value. If yes, the microcontroller 140 performs step S340. In step S340, the microcontroller 140 drives the second light emitting unit 112 to have the second light emitting unit 112 provide 100% of brightness, and performs step S310 again. In other words, if the light attenuation rate is lower than the first threshold value, it indicates that the current visibility around the street light device 100 is high, so the street light device 100 only needs to provide an illumination light (for example, a white light with a color temperature of 5000K) with the second light emitting unit 112.

In step S330, if the microcontroller 140 determines that the light attenuation rate is not lower than the first threshold value, the microcontroller 140 performs step S350. In step S350, the microcontroller 140 determines whether the light attenuation rate is lower than a second threshold value. The second threshold value is higher than the first threshold value. If yes, the microcontroller 140 performs step S360. In step S360, the microcontroller 140 drives the first light emitting unit 111 and the second light emitting unit 112 to have the first light emitting unit 111 provide 30% of brightness and the second light emitting unit 112 provide 70% of brightness, and performs step S310 again. In other words, if the light attenuation rate falls between the first threshold value and the second threshold value, it indicates that the current visibility around the street light device 100 is slightly low, so the street light device 100 provides an illumination light (for example, a yellow light with a color temperature of 2700K) of 30% of brightness with the first light emitting unit 111 and an illumination light of 70% of brightness with the second light emitting unit 111 simultaneously.

In step S350, if the microcontroller 140 determines that the light attenuation rate is not lower than the second threshold value, the microcontroller 140 performs step S370. In step S370, the microcontroller 140 determines whether the light attenuation rate is lower than a third threshold value. The third threshold value is higher than the second threshold value. If yes, the microcontroller 140 performs step S380. In step S380, the microcontroller 140 drives the first light emitting unit 111 and the second light emitting unit 112 to have the first light emitting unit 111 provide 70% of brightness and the second light emitting unit 112 provide 30% of brightness, and performs step S310 again. In other words, if the light attenuation rate falls between the second threshold value and the third threshold value, it indicates that the current visibility around the street light device 100 is quite low, so the street light device 100 provides an illumination light of 70% of brightness with the first light emitting unit 111 and an illumination light of 30% of brightness with the second light emitting unit 111 simultaneously.

In step S370, if the microcontroller 140 determines that the light attenuation rate is not lower than the third threshold value, the microcontroller 140 performs step S390. In step S390, the microcontroller 140 drives the first light emitting unit 111 to have the first light emitting unit 111 provide 100% of brightness, and performs step S310 again. In other words, if the light attenuation rate is higher than the third threshold value, it indicates that the current visibility around the street light device 100 is really low, so the street light device 100 needs to provide an illumination light with the first light emitting unit 111 of 100% of brightness.

Figure 4:
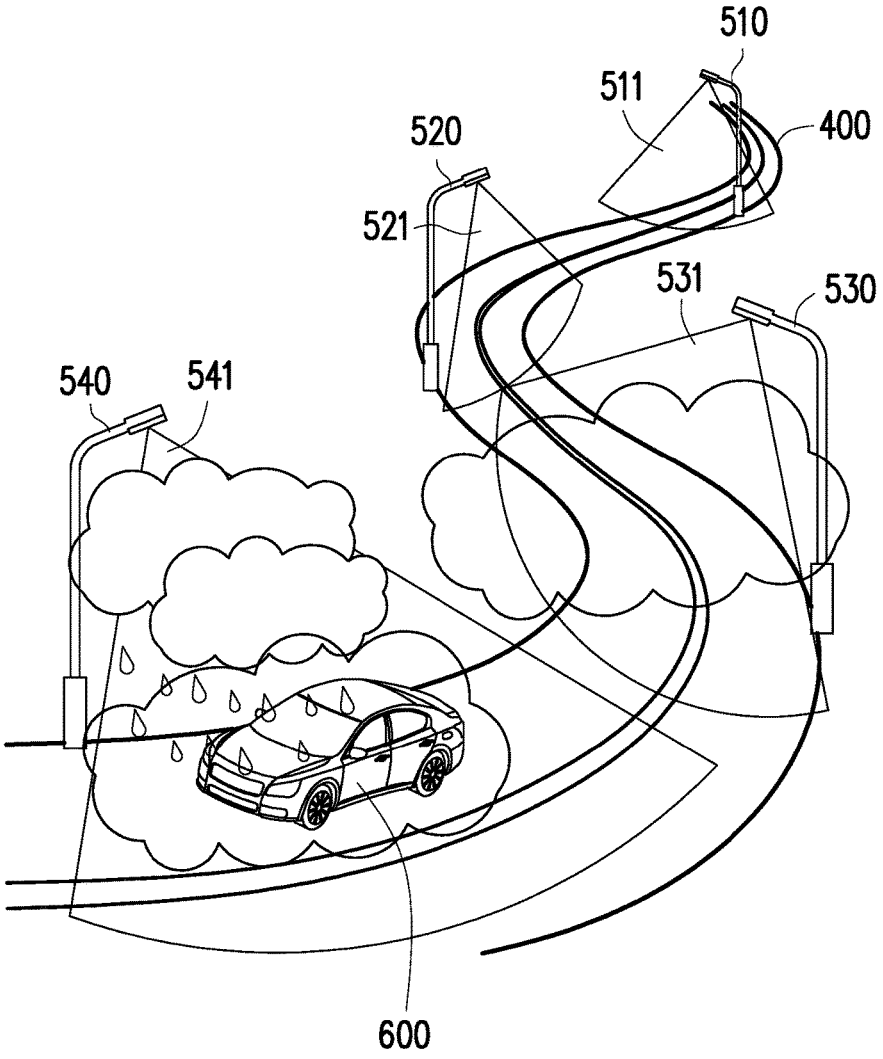
FIG. 4 is a schematic view of a street light system according to an embodiment of the disclosure.

FIG. 4 is a schematic view of a street light system according to an embodiment of the disclosure. Referring to FIG. 3 and FIG. 4, a plurality of street light devices 510 to 540 of FIG. 4 are sequentially disposed beside the road 400 to generate a plurality of illumination areas 511 to 541 at a plurality of locations on the road 400, respectively. In this embodiment, the street light device 510 to 540 may independently perform the operation method of the embodiment of FIG. 3 as described above. For example, when a vehicle 600 passes through an illumination area 511, the street light device 510 may automatically determine that it is not raining and not foggy in the illumination area 511 (high visibility), so the street light device 510 may perform step S340 as described above to provide 100% of white light. When a vehicle 600 passes through an illumination area 521, the street light device 520 may automatically determine that it is not raining but slightly foggy in the illumination area 521 (slightly low visibility), so the street light device 520 may perform step S360 as described above to provide 30% of yellow light and 70% of white light. When a vehicle 600 passes through an illumination area 531, the street light device 530 may automatically determine that there is heavy fog in the illumination area 531 (quite low visibility), so the street light device 530 may perform step S380 as described above to provide 70% of yellow light and 30% of white light. When a vehicle 600 passes through an illumination area 541, the street light device 540 may automatically determine that it is raining with heavy fog in the illumination area 541 (really low visibility), so the street light device 540 may perform step S390 as described above to provide 100% of yellow light. Accordingly, the street light devices 510 to 540 of the street lamp system of this embodiment respectively sense the environmental parameters of the corresponding illumination area to automatically determine the visibility therein. Therefore, the street light devices 510 to 540 of this embodiment automatically adjust the color temperature of the illumination light effectively according to the visibility of the corresponding illumination area.

Furthermore, other circuit details and operation method of the street light devices 510 to 540 of this embodiment may be understood sufficiently from the teaching, suggestion, and illustration of the embodiments of FIG. 1 to FIG. 3 and thus are not repeated hereinafter.

Figure 5:
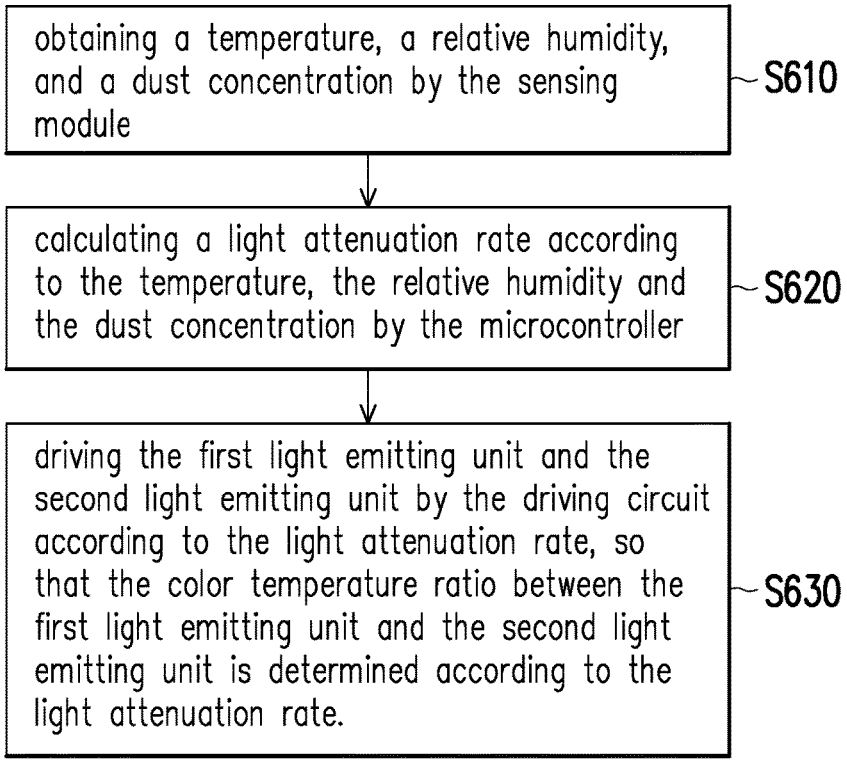
FIG. 5 is a flowchart of an operation method of a street light device according to an embodiment of the disclosure.

FIG. 5 is a flowchart of an operation method of a street light device according to an embodiment of the disclosure. Referring to FIG. 1, FIG. 2 and FIG. 5, the method of FIG. 5 is at least applicable to the street light device 100 shown in FIG. 1 and the street light device 100 shown in FIG. 2. The street light device 100 may perform step S610 to step S630. In step S610, the microcontroller 140 obtains a temperature, a relative humidity, and a dust concentration by the sensing module 130. In step S620, the microcontroller 140 calculates a light attenuation rate according to the temperature, the relative humidity, and the dust concentration. In step S630, the microcontroller 140 drives the first light emitting unit 111 and the second light emitting unit 112 according to the light attenuation rate, so that the color temperature ratio between the first light emitting unit 111 and the second light emitting unit 112 is determined according to the light attenuation rate. As such, the street light device 100 may effectively adjust a color temperature ratio between the first light emitting unit 111 and the second light emitting unit 112.

Furthermore, other circuit details and operation method of the street light devices 100 of this embodiment may be understood sufficiently from the teaching, suggestion, and illustration of the embodiments of FIG. 1 to FIG. 4 and thus are not repeated hereinafter.

In summary, the street light device and an operation method thereof of this disclosure calculates a light attenuation rate by automatically sensing the temperature, the relative humidity, and the dust concentration of the surrounding environment of the street light device. Next, the street light device and an operation method thereof of this disclosure correspondingly adjust the brightness of the first light emitting unit and the second light emitting unit having different color temperatures according to the light attenuation rate, so that the street light device and the operation method thereof of this disclosure effectively provide an illumination effect having a corresponding color temperature based on the surrounding environment of the street light device.

It will be apparent to those skilled in the art that various modifications and variations can be made to the disclosed embodiments without departing from the scope or spirit of this disclosure. In view of the foregoing, it is intended that the disclosure covers modifications and variations provided that they fall within the scope of the following claims and their equivalents.

What is claimed is:

1. A street light device, comprising:

a light emitting module, comprising a first light emitting unit and a second light emitting unit;

a driving circuit, coupled to the light emitting module, wherein the driving circuit is configured to drive the first light emitting unit and the second light emitting unit;

a sensing module, configured to obtain a temperature, a relative humidity, and a dust concentration; and a microcontroller, coupled to the sensing module and the driving circuit, wherein the microcontroller is configured to calculate a light attenuation rate according to the temperature, the relative humidity, and the dust concentration, wherein the microcontroller controls the driving circuit according to the light attenuation rate to drive the first light emitting unit and the second light emitting unit, so that a color temperature ratio between the first light emitting unit and the second light emitting unit is determined according to the light attenuation rate.

2. The street light device according to claim 1, wherein the first light emitting unit has a first color temperature, and the second light emitting unit has a second color temperature, wherein the first color temperature is lower than the second color temperature.

3. The street light device according to claim 1, wherein the driving circuit outputs a first driving current to the first light emitting unit and outputs a second driving current to the second light emitting unit, wherein a value of the light attenuation rate is proportional to a current value of the first driving current, and the value of the light attenuation rate is inversely proportional to a current value of the second driving current.

4. The street light device according to claim 1, wherein the microcontroller determines whether the light attenuation rate is lower than a preset threshold value to determine a brightness of the first light emitting unit and the second light emitting unit by the driving circuit, wherein if the light attenuation rate is lower than the preset threshold value, the first light emitting unit has a first brightness, and the second light emitting unit has a second brightness, if the light attenuation rate is higher than or equal to the preset threshold value, the first light emitting unit has a third brightness, and the second light emitting unit has a fourth brightness, wherein the first brightness is lower than the third brightness, and the second brightness is higher than the third brightness.

5. The street light device according to claim 1, wherein the microcontroller calculates a saturated vapor pressure according to the temperature, and calculates a density of moist air according to the relative humidity, the saturated vapor pressure, and a density of dry air, wherein the microcontroller calculates the light attenuation rate according to the density of moist air, the dust concentration, and the density of dry air.

6. An operation method of a street light device, comprising:

obtaining a temperature, a relative humidity, and a dust concentration by a sensing module;

calculating a light attenuation rate according to the temperature, the relative humidity and, the dust concentration by a microcontroller; and driving a first light emitting unit and a second light emitting unit of the street light device by a driving circuit according to the light attenuation rate, so that a color temperature ratio between the first light emitting unit and the second light emitting unit is determined according to the light attenuation rate.

7. The operation method according to claim 6, wherein the first light emitting unit has a first color temperature, and the second light emitting unit has a second color temperature, wherein the first color temperature is lower than the second color temperature.

8. The operation method according to claim 6, wherein the driving circuit outputs a first driving current to the first light emitting unit and outputs a second driving current to the second light emitting unit, wherein a value of the light attenuation rate is proportional to a current value of the first driving current, and the value of the light attenuation rate is inversely proportional to a current value of the second driving current.

9. The operation method according to claim 6, wherein driving the first light emitting unit and the second light emitting unit of the street light device by the driving circuit according to the light attenuation rate comprises:

determining, by the microcontroller, whether the light attenuation rate is lower than a preset threshold value, to determine a brightness of the first light emitting unit and the second light emitting unit through the driving circuit;

if the light attenuation rate is lower than the preset threshold value, driving the first light emitting unit and the second light emitting unit by the driving circuit, wherein the first light emitting unit has a first brightness, and the second light emitting unit has a second brightness; and if the light attenuation rate is higher than or equal to the preset threshold value, driving the first light emitting unit and the second light emitting unit by the driving circuit, wherein the first light emitting unit has a third brightness, and the second light emitting unit has a fourth brightness, wherein the first brightness is lower than the third brightness, and the second brightness is higher than the third brightness.

10. The operation method according to claim 6, wherein calculating the light attenuation rate according to the temperature, the relative humidity, and the dust concentration by the microcontroller comprises:

calculating a saturated vapor pressure according to the temperature by the microcontroller;

calculating a density of moist air according to the relative humidity, the saturated vapor pressure, and a density of dry air by the microcontroller; and calculating the light attenuation rate according to the density of moist air, the dust concentration, and the density of dry air by the microcontroller.

* * * * *